United States Patent [19]

Kelly

[11] Patent Number: 5,040,248

[45] Date of Patent: Aug. 20, 1991

[54] STAND-UP TRAINING POTTY FOR MALE TODDLERS

[76] Inventor: Adele Z. Kelly, 3714 N. Haight, Portland, Oreg. 97227

[21] Appl. No.: 610,350

[22] Filed: Nov. 6, 1990

Related U.S. Application Data

[63] Continuation of Ser. No. 332,998, Apr. 4, 1989, abandoned

[51] Int. Cl.[5] ..... A47K 4/00; A47K 11/00

[52] U.S. Cl. ..... 4/462; 4/144.4

[58] Field of Search ..... 4/301, 302, 149.1, 149.3, 4/144.4

[56] References Cited

U.S. PATENT DOCUMENTS

| | | | |
|---|---|---|---|
| 246,881 | 9/1881 | Hartman | 4/462 |
| 620,039 | 2/1899 | Kendrick | 4/462 |
| 1,650,155 | 11/1927 | Randle | 4/458 |
| 2,243,791 | 5/1941 | Botenstein | 4/144.4 |
| 2,600,478 | 6/1952 | Butcher | 4/144.4 |
| 3,327,324 | 6/1967 | Marsch | 4/449 |
| 3,448,467 | 6/1969 | Smith | 4/463 |
| 3,629,874 | 12/1971 | Beller | 4/483 |
| 3,822,419 | 7/1974 | Wilson, Sr. | 4/144.4 |
| 4,032,998 | 7/1977 | England | 4/449 |
| 4,462,122 | 7/1984 | Broeils | 4/235 |
| 4,683,598 | 8/1987 | Jones | 4/144.1 |

FOREIGN PATENT DOCUMENTS

| | | | |
|---|---|---|---|
| 386622 | 4/1965 | Switzerland | 4/144.1 |
| 139131 | 2/1920 | United Kingdom | 4/144.1 |

*Primary Examiner*—Henry J. Recla
*Assistant Examiner*—David J. Walczak
*Attorney, Agent, or Firm*—Kolisch, Hartwell, Dickinson, McCormack & Heuser

[57] ABSTRACT

An improved stand-up training potty for male toddlers is disclosed. A commode having a waste-receiving pot and an open seat is equipped with a detachably fastenable urinal accessory including a conduit for receiving urine and communicating it into the pot, the conduit having an elongate region that extends upwardly and forwardly from the commode. The height of the open seat of the commode, the extent and direction in which the elongate region of the conduit extends from the commode, and the height of an open, urine-receiving end of the conduit are fixably adjustable. In a preferred embodiment, the elongate region of the conduit includes nested, interlocking, slidably extendable/retractable cylindrical members. In a modification, such a urinal accessory is provided for use with a conventional training potty, the accessory having detachable fastener means that accommodate potties have a wide range of seat depths.

3 Claims, 1 Drawing Sheet

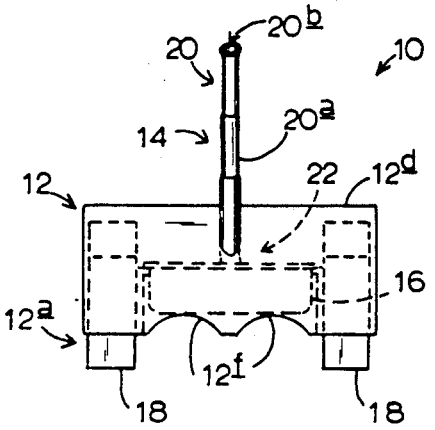
FIG.1
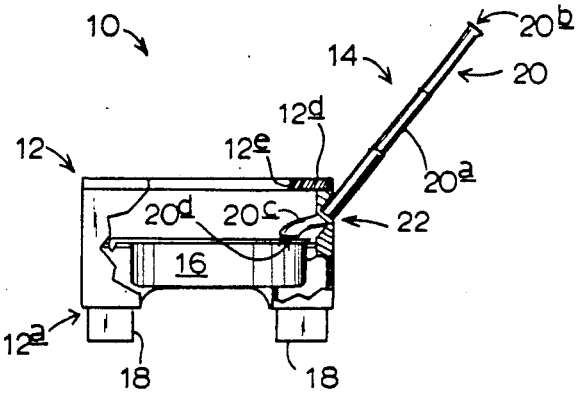
FIG. 2
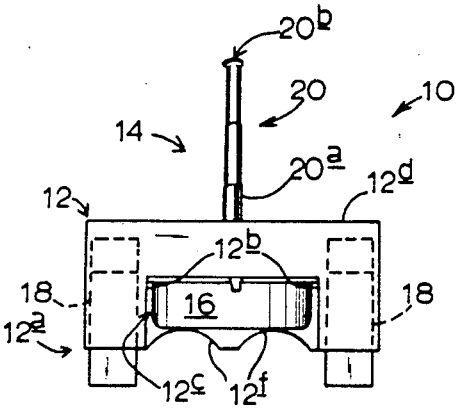
FIG.3
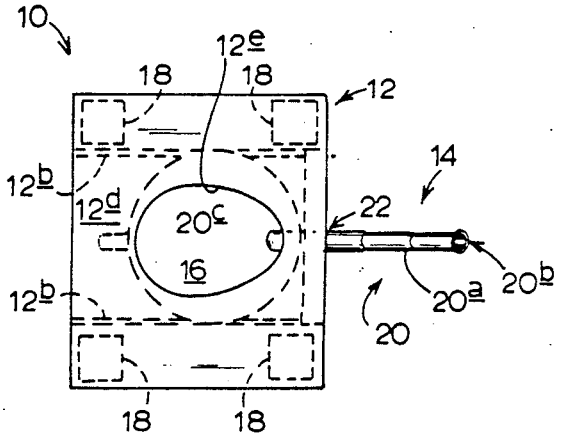
FIG.4
FIG.5
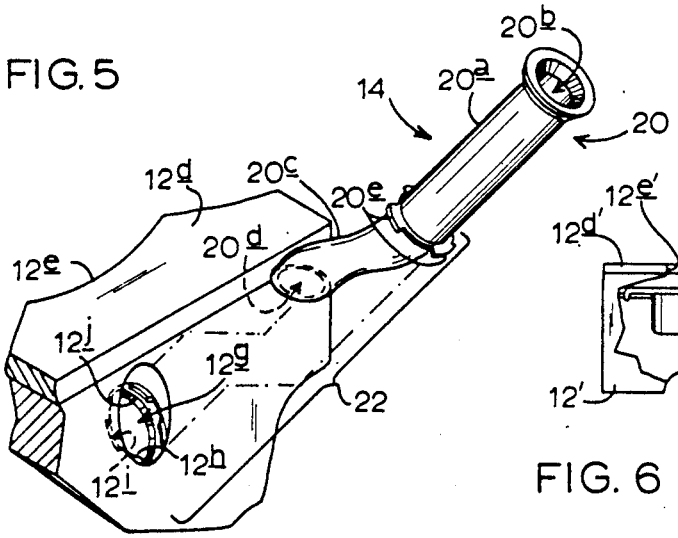
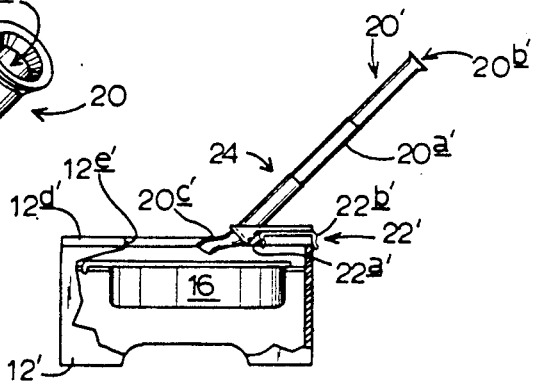
FIG. 6

STAND-UP TRAINING POTTY FOR MALE TODDLERS

This is a continuation of application Ser. No. 07/332,998 filed Apr. 4, 1989, now abandoned.

BACKGROUND AND SUMMARY OF THE INVENTION

This invention relates generally to training potties. More specifically, it concerns a urinal accessory for use in training male toddlers to urinate while standing.

Training potties that provide for a toddler's seated use are well-known. They are typically lightweight and portable, having a base, an open seat thereabove at a suitable height for sitting, and a waste-receiving pot aligned beneath the opening in the seat providing access to the pot for elimination (defecation and/or seated urination). Training potties traditionally have been unisex, i.e. intended for use by both male and female toddlers. Their unisex design has been unaccommodating of male toddlers, since it is difficult for a male toddler to direct his urine into a pot from a seated position. A shield appended to the front edge of the seat's opening has been known to be used with such a training potty for deflecting the stream of urine into the training potty's pot, but the effectiveness of such a shield is at best hit-and-miss Of course, most male adults do not urinate sitting down, so a shield-equipped 'training' potty fails in its primary purpose: to train male toddlers to urinate the way they will be expected to as adults.

Accordingly, it is a principal object of the invention to provide an improved training potty that encourages and facilitates its use by male toddlers who are learning to urinate while standing.

It is another object of the invention to provide a detachable accessory, compatible with conventional training potties, that conveniently may be used to teach male toddlers to urinate while standing.

A further object is to provide a portable stand-up training potty that fixably may be adjusted by the user to a desired height.

Another object is to provide such an improved training potty that still may be used conventionally by male and female toddlers to eliminate while seated.

Still another object of the invention is to provide an improved training potty that is inexpensive to manufacture, easily operated, hygienic, and virtually maintenance-free.

These and other objects and advantages of the present invention will be more clearly understood from a consideration of the accompanying drawings and description of the preferred embodiment.

BRIEF DESCRIPTION OF THE DRAWINGS

FIG. 1 is a front elevation of the improved training potty apparatus of the invention made in accordance with its preferred embodiment.

FIG. 2 is a side elevation corresponding to FIG. 1 and showing in cutaway detail the cooperation of the urine conveyance means and the commode.

FIG. 3 is a rear elevation corresponding to FIG. 1.

FIG. 4 is a top view of the apparatus in its preferred embodiment.

FIG. 5 is a detailed isometric view of the detachable fastener means made in accordance with the preferred embodiment of the invention.

FIG. 6 is an enlarged side elevation corresponding generally to FIG. 2, but showing a proposed modification in which a urinal accessory is attached to a conventional potty.

DETAILED DESCRIPTION OF THE PREFERRED EMBODIMENT

Referring collectively to Figs. 1 through 4, an improved, stand-up training potty for male toddlers, constructed in accordance with the preferred embodiment of the invention, is indicated generally at 10. Improved training potty 10, which may be made of any lightweight, durable material, e.g. a molded polymer, comprises a portable commode 12 and urine conveyance means 14 operatively connected therewith. Commode 12 includes a waste-receiving pot 16 and a rectilinear base portion indicated generally at 12*a* including, in the preferred embodiment, four corner legs 18. As may be seen from FIG. 3, a radially extending, annular lip region of pot 16 is supported on base 12*a* by laterally spaced, opposing shoulders 12*b* on base 12*a*. Thus, as with conventional training potties, pot 16 may be removed, for emptying and cleaning, through a rear opening 12*c* in commode 12. Finally, commode 12 includes a seat 12*d* having an opening 12*e* therein that provides access to pot 16 for elimination by a seated toddler.

Legs 18 may be extended and retracted into corresponding vertical channels within base 12*a*, thereby to permit the height adjustment of seat 12*d* above the surface, e.g. the floor, on which improved training potty 10 rests. The extent of legs 18 from base 12*a* may be rendered fixable in any known manner, e.g. by the provision of a series of alignable hole pairs or detents in legs 18 and base 12*a*. Thus, apparatus 10 may be made to accommodate a range of user heights and to ensure the users' comfort during their seated use of commode 12. A pair of laterally spaced, semicircular cutouts 12*f* are provided, in the preferred embodiment, in the lower front edge of base 12*a*, thereby partly to receive the feet of the toddler, whether seated or standing.

Referring still to Figs. 1 through 4, urine conveyance means 14 and detachable fastener means 22 will be described in detail. Conveyance means 14 includes a conduit 20, which in the preferred embodiment is co-extensive with conveyance means 14, for receiving urine and communicating it into pot 16. An elongate region 20*a* of conduit 20 extends upwardly and forwardly from commode 12, and has a first open end 20*b* for receiving urine from a toddler standing forwardly of commode 12 (to the right in FIG. 2). Another region 20*c* of conduit 20 in fluid communication with elongate region 20*a* extends rearwardly from the front of commode 12 to an elevation just above pot 16, and has a second open end 20*d* for discharging urine received into open end 20*b*. It will be appreciated that region 20*c* of conduit 20 may be integrally molded into base 12*a*, or it may be integrally molded into conveyance means 14, to be detachable for cleaning therewith. It will be appreciated that urine conveyance means 14 may be gradually tapered outwardly, or flared, in the direction of its upward and forward extent, although this is not believed to be the preferred embodiment, for reasons that will become clear. In the preferred embodiment, the conduit's open end 20*b* is dimension to receive at least partly therein a toddler's penis. This provides for the secure and spill-proof conveyance of urine into pot 16, even from a male toddler who lacks bladder control or manual dexterity.

In the preferred embodiment of the invention, conveyance means 14 is detachable from commode 12 for the purposes of cleaning conveyance means 14 and sitting on commode 12. Thus, detachable fastener means 22 is provided for operatively connecting conduit 20 with commode 12. Fastener means 22 is configured to connect conduit 20 with commode 12, with elongate region 20*a* extending upwardly and forwardly from commode 12 as shown in FIG. 2. Detachable fastener means 22 may take the simple form of a recess 12*g* in base 12*a* dimensioned frictionally to receive therein an extreme end of elongate region 20*a* of conduit 20. If a more secure arrangement is desired, detachable fastener means 22 may take the preferred form of a twist-lock mechanism as is known for fastening generally cylindrical members to base structures, e.g. a member having a set of arcuately spaced, radially projecting tabs in cooperation with a base structure having a set of corresponding openings in the outer wall of an annular recess. It will be appreciated that any suitable detachable fastener means, preferably means that is operable by a toddler, may be used.

Base 12*a*, legs 18 and conVeyance means 14 may be seen to provide means for fixably adjusting the height of open end 20*b* of conduit 20. This is because extending or retracting legs 18 from or into base 12*a* effects the height adjustment of open end 20*b* even if conduit 20 itself has a fixed extent from commode 12. In accordance with the preferred embodiment of the invention, means are provided for fixably adjusting the extent of elongate region 20*a* of conduit 20 by constructing region 20*a* as a series of coaxially nested, interlocking, cylindrical members that may be resistively slidably extended or retracted along their axis to a desired length.

It will be appreciated that, in the preferred embodiment, the cylindrical members decrease in diameter in the direction of their upward and forward extent, because this configuration is seen to minimize resistance to the flow of urine into pot 16 and accumulation of urine in the region of joinder between the nested, cylindrical members. Those of skill in the art will appreciate that conduit 20 need not be rigid, but rather may be resistively articulable, thereby to enable also the fixable adjustment of the direction in which elongate region 20*a* extends from commode 12. For example, elongate region 20*a* may take the form of a shape-retentive accordion member that is capable not only of lengthwise extension and retraction, but also of bending or inclination relative to commode 12.

FIG. 5 shows, in enlarged fragmentary detail, detachable fastener means 22 made in accordance with the preferred embodiment of the invention. Cylindrical recess 12*g* is equipped with an annular recess the outer wall 12*h* of which forms arcuately spaced openings 12*i* that correspond thus to cooperate with arcuately spaced, radially projecting tabs 20*e* of conduit 20 (shown fully lengthwise retracted in FIG. 5). Thus, a twist-lock mechanism for detachably fastening conveyance means 14 with commode 12 is provided. Importantly, the circular end wall of recess 12*g* has an opening, bounded by an annular shoulder 12*j*, sufficient to receive therethrough region 12*c* of conduit 20. In order to install conveyance means 14 on commode 12, one need merely guide region 12*c* into recess 12*g* and through the opening therein, align tabs 20*e* with corresponding openings 12*i*, urge tabs 20*e* against shoulder 12*j* and twist conduit 20 (until it is aligned in a vertical plane) to lockingly secure it to base 12*a*.

Importantly, since conduit 20 provides for urine conveyance from its open, urine-receiving end 20*b* to its open, urine-discharging end 20*d*, it may be seen that in the preferred embodiment all parts of urine conveyance means 14 that are likely to come into contact with urine are integrally removable for cleaning. Similarly, by dimensioning conduit 20 so that region 20*c* extends downwardly to an elevation just above that of opposing shoulders 12*b* of base 12*a*, waste-receiving pot 16 may be removed from commode 12 through rear opening 12*c* (refer to FIG. 3) without interference with, or removal of, urine conveyance means 14. Thus, the solution to the problem of training male toddlers to urinate while standing up further provides hygienic, almost maintenance-free facility.

Turning now to FIG. 6, a modification to the preferred embodiment of the invention is described. A conventional training potty 12', having a waste-receiving pot 16' and an open seat 12*d'* for supporting a seated toddler during elimination, is shown with a urinal accessory 24 detachably affixed thereto. In this modified embodiment, accessory 24 includes a urine conveyance conduit 20' for receiving urine and communicating it into waste-receiving pot 16', and detachable fastener means 22' for operatively connecting conduit 20' to conventional potty 12'. An elongate region 20*a'*of conduit 20' has an open end 20*b'* for receiving urine, from a toddler standing forwardly of conventional potty 12' (to the right in FIG. 6), at a height substantially above that of open seat 12*d'*. Fastener means 22' are configured to connect conduit 20' to conventional potty 12' with elongate region 20*a'* extending upwardly and forwardly from the potty, as in the preferred embodiment described above.

In the modification to the preferred embodiment, fastener means 22' includes a pair of opposing fingers 22*a'*, 22b' formed to ° 15 slip over, and grasp, a front region of open seat 12d'. Those skilled in the art will appreciate that fastener means 22' may be structured to accommodate potties having a wide range of seat depths in the front region to be grasped thereby. This may be done, for example, by equipping fastener means 22' with a rear finger 22*a'* that is fixably slidably adjustable relative to front finger 22*b'*, e.g. in a slotted hole. Thus, urinal accessory 24 is adaptable for use with, yet requires no modification to, conventional training potty 12', and retrofittably yields many of the advantages of the preferred embodiment.

In the proposed modification, conduit 20' may include means for fixably adjusting the extent of elongate region 20*a'*, may include means for fixably adjusting the height of open end 20*b'*, and may include means for fixably adjusting the direction at which elongate region 20*a'* extends from conventional potty 12', as in the preferred embodiment of the invention. Indeed, conduit 20' may, as illustrated in FIG. 6, be formed identically as conduit 20 of the preferred embodiment, with detachable fastener means 22' and its mounting of the conduit representing the only differences.

In the illustrated embodiments, urine conveyance means, or a conduit, which is operatively connected with a commode or training potty, are provided for receiving urine and communicating it into a waste-receiving pot associated with the commode or potty. It may be seen by reference to FIGS. 2 and 6 that an elongate region of the conduit (e.g. region 20*a* of the preferred embodiment or region 20' of the modification) has a first open end (e.g. open end **20*b* of the preferred embodiment or open end 20*b'* of the modification) for receiving urine from a toddler standing forwardly of the commode or potty. It also may be seen that another region of the conduit (e.g. region 20*c* of the preferred embodiment or region 20*c'* of the modification) in fluid communication with the elongate region, extends rearwardly and downwardly from the upper front of the commode or potty to an elevation just above the pot and has a second open end (e.g. open end 20*d* of the preferred embodiment or open end 20*d'*** of the modification) for discharging urine received into the first open end.

In the illustrated embodiments, fastener means are provided for detachably fastening the conduit with the commode or training potty, with the fastener means being configured to connect the two with the elongate region of the conduit extending upwardly and forwardly from the commode or potty. Adjustment means are provided for fixably adjusting the height of the open end of the conduit at a height substantially above that of the open seat of the commode or potty. This substantial height difference between the open end of the conduit and the open seat of the commode or potty (which is preferably approximately a factor of two) achieves the desired, generally knee-high elevation of the open seat and the desired, generally waist-high elevation of the open end. Thus, a toddler comfortably may sit on the commode or potty to eliminate, without dangling his or her legs, and a toddler comfortably may stand forwardly of the commode or potty to urinate, without bending his knees.

Importantly, the illustrated embodiments—whether made to fit the portable commode of the preferred embodiment or the conventional training potty of the modification—provide for the easy attachment and detachment of the urine conveyance means or conduit from the commode or potty. Installation and removal of the urinal accessory or urine conveyance means imposes only a nominal burden on the parent responsible for the potty training, and desirous of the proper training, of a male toddler. In addition to facilitating cleaning of the urinal accessory, detachability facilitates conventional seated use of the commode or potty. Thus, male and female toddlers alike conveniently may use the improved training potty while sitting, and male toddlers, for whom stand-up urination training is particularly important, may use the improved training potty while standing.

Accordingly, while the preferred embodiment of the invention and a modification thereto have been described herein, it is appreciated that further modifications are possible that come within the scope of the invention.

I claim:

1. For use in training toddlers to urinate while standing, an improved training potty comprising:

a portable commode including a pot for receiving waste, a base supporting said pot, said base including an open seat, plural channels and plural legs depending from said channels, said open seat providing access to said pot for elimination by a seated toddler, when seated on said seat, with said legs being fixably lengthwise extendable/retractable relative to said channels for fixably adjusting the height of said seat within a predefined range of heights while maintaining it in a generally horizontal orientation;

an elongate rigid urine conveyance conduit operatively connected with said commode, said conduit being configured for receiving urine and communicating the same into said pot, said conduit having a first open end for receiving urine from a toddler, when standing forwardly of said commode, said conduit having a second open end in fluid communication with said first open end for discharging into said pot urine received into said first open end; and adjustment means for fixably adjusting the height of said open end of said conduit within a predefined range of heights including a height substantially above that of said open seat of said commode, with said adjustment means being operable independently from said extendable/retractable legs.

2. The training potty of claim 1, wherein the diameter of said open end is dimensioned to receive therein a toddler's penis.

3. The training potty of claim 1, wherein said conduit comprises plural coaxially nested slidable interlocking members.

* * * * *